US007950372B2

(12) United States Patent
Powell

(10) Patent No.: US 7,950,372 B2
(45) Date of Patent: May 31, 2011

(54) BY-PASS REGULATOR ASSEMBLY FOR DUAL ERFS/MRFS FUEL PUMP MODULE

(75) Inventor: Patrick Powell, Farmington Hills, MI (US)

(73) Assignee: DENSO International America, Inc., Southfield, MI (US)

( * ) Notice: Subject to any disclaimer, the term of this patent is extended or adjusted under 35 U.S.C. 154(b) by 0 days.

(21) Appl. No.: 12/012,475

(22) Filed: Feb. 1, 2008

(65) Prior Publication Data

US 2009/0194075 A1 Aug. 6, 2009

(51) Int. Cl.
*F02M 37/00* (2006.01)
*F04B 23/08* (2006.01)

(52) U.S. Cl. ..... 123/511; 123/510; 123/512; 123/514; 417/87; 137/565.22

(58) Field of Classification Search ..... 123/510–512; 417/87, 151; 137/565.22
See application file for complete search history.

(56) References Cited

U.S. PATENT DOCUMENTS 3,908,376 A * 9/1975 Steiger ..... 60/428
4,458,713 A 7/1984 Wernberg
4,800,859 A * 1/1989 Sagisaka et al. ..... 123/497
5,379,741 A * 1/1995 Matysiewicz et al. ..... 123/497
5,483,940 A * 1/1996 Namba et al. ..... 123/497
5,579,738 A * 12/1996 Frischmuth et al. ..... 123/497
5,590,631 A * 1/1997 Tuckey ..... 123/447
5,699,772 A * 12/1997 Yonekawa et al. ..... 123/497
5,711,275 A * 1/1998 Minagawa et al. ..... 123/458
5,715,797 A * 2/1998 Minagawa et al. ..... 123/497
5,740,783 A * 4/1998 Learman et al. ..... 123/497
5,975,061 A 11/1999 Briggs et al.
6,024,072 A * 2/2000 Hamada ..... 123/497
6,155,238 A 12/2000 Briggs et al.
6,352,067 B1 * 3/2002 Genslak ..... 123/510
6,526,948 B1 * 3/2003 Stavnheim et al. ..... 123/497
6,694,950 B2 * 2/2004 Djordjevic ..... 123/446
6,712,043 B2 * 3/2004 Sadfa ..... 123/447
6,907,899 B2 * 6/2005 Yu et al. ..... 137/565.22
7,048,515 B2 * 5/2006 Shimomura et al. ..... 417/213
7,121,266 B2 * 10/2006 Powell ..... 123/509
7,216,633 B2 * 5/2007 Attwood et al. ..... 123/509
7,277,789 B1 * 10/2007 Gibson et al. ..... 701/104
7,302,938 B2 * 12/2007 Yu et al. ..... 123/514
7,318,414 B2 * 1/2008 Hou ..... 123/458
7,353,807 B2 * 4/2008 Paluszewski ..... 123/509
2004/0250795 A1 * 12/2004 Stroia et al. ..... 123/447
2005/0034710 A1 * 2/2005 Crary et al. ..... 123/457

* cited by examiner

*Primary Examiner* — Stephen K Cronin
*Assistant Examiner* — David Hamaoui
(74) *Attorney, Agent, or Firm* — Harness, Dickey & Pierce, PLC

(57) ABSTRACT

A fuel system that supplies fuel to an engine of a vehicle. The fuel system includes a pump that pumps fuel and a controller that selectively changes operation of the pump between an electronic returnless fuel system mode and a mechanical returnless fuel system mode. In the electronic returnless fuel system mode, the outlet of the pump is varied, and in the mechanical returnless fuel system mode, output of the pump is maintained approximately constant.

18 Claims, 7 Drawing Sheets

BY-PASS REGULATOR ASSEMBLY FOR DUAL ERFS/MRFS FUEL PUMP MODULE

FIELD

The present disclosure relates to a regulator assembly and, more particularly, relates to a by-pass regulator assembly for dual ERFS/MRFS fuel pump module.

BACKGROUND

The statements in this section merely provide background information related to the present disclosure and may not constitute prior art.

Vehicles typically include a fuel system for supplying fuel from a fuel tank to an engine. In some fuel systems, the pump operates at a relatively constant speed, and fuel that is not used by the engine is returned to the fuel tank. However, because the fuel pump is operated at a relatively constant speed regardless of the fuel demand of the engine, operation of this type of fuel system can be inefficient.

Other fuel systems can include an electronic controller for controlling the pump. The controller varies voltage to the pump according to the fuel demand of the engine. As such, the pump operates according to the fuel demand for increased efficiency of the fuel pump assembly. However, when fuel demand is high, the controller is more likely to malfunction due to the relatively high amount of current supplied to the pump.

SUMMARY

A fuel system is disclosed that supplies fuel to an engine of a vehicle. The fuel system includes a pump that pumps fuel and a controller that selectively changes operation of the pump between an electronic returnless fuel system mode and a mechanical returnless fuel system mode. In the electronic returnless fuel system mode, the outlet of the pump is varied, and in the mechanical returnless fuel system mode, output of the pump is maintained approximately constant.

In another aspect, a method of operating a fuel system for a vehicle with an engine and a fuel pump is disclosed. The method includes operating the fuel pump in an electronic returnless fuel system mode, in which output of the pump is varied, when a fuel demand of the engine is at most equal to a predetermined limit. The method further includes operating the fuel pump in a mechanical returnless fuel system mode, in which output of the pump is maintained approximately constant, when a fuel demand of the engine is above the predetermined limit.

In still another aspect, a fuel system that supplies fuel to an engine of a vehicle is disclosed. The fuel system includes a pump that pumps fuel and a junction member assembly that is in fluid communication with the pump. The junction member includes an outer housing defining an inlet, an engine outlet, a jet pump outlet, and a pressure regulator outlet. The junction member assembly also includes a flow insert member that defines a first passage and a pressure regulator passage. Moreover, the junction member includes a pressure regulator member that is coupled to the flow insert member adjacent the pressure regulator outlet. A first portion of fuel flows from the inlet, through the first passage, and through the engine outlet. A second portion of fuel flows from the inlet, through the second passage, and through the jet pump outlet. Also, fuel flows from the first passage, flows through the pressure regulator passage, changes the pressure regulator member to an open position, and flows out of the junction member assembly when fuel pressure supplied to the engine exceeds a predetermined pressure limit. The fuel system additionally includes a controller that selectively changes operation of the pump between an electronic returnless fuel system (ERFS) mode, in which output of the pump is varied, and a mechanical returnless fuel system (MRFS) mode, in which output of the pump is maintained approximately constant. The controller changes operation of the pump from the MRFS mode to the ERFS mode when a fuel demand of the engine is at most a predetermined limit. The controller also changes operation of the pump from the ERFS mode to the MRFS mode when the fuel demand of the engine is above the predetermined limit. The controller additionally controls operation of the pump in the ERFS mode such that the fuel pressure supplied to the engine is below the predetermined pressure limit.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
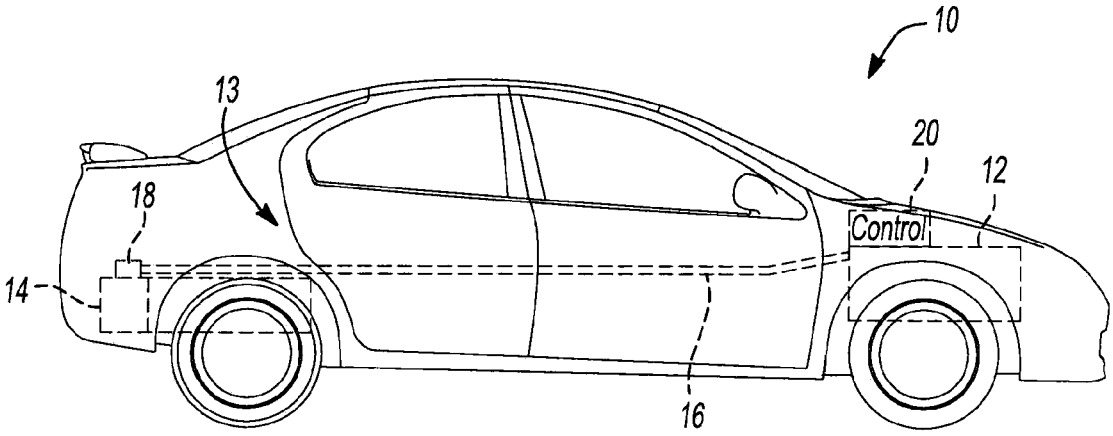
FIG. 1 is a side view of a vehicle with a fuel system according to the present disclosure.

The following description is merely exemplary in nature and is not intended to limit the present disclosure, application, or uses. It should be understood that throughout the drawings, corresponding reference numerals indicate like or corresponding parts and features.

Initially referring to FIG. 1, a vehicle 10 is illustrated. The vehicle 10 includes an engine 12, which is illustrated schematically. The vehicle 10 further includes a fuel system, generally indicated at 13. It will be appreciated that the vehicle 10 could be of any suitable type, such as a car, a truck, a sport-utility vehicle, a van, a motor cycle, and the like. It will also be appreciated that the engine 12 can be an internal combustion engine of any suitable type, such as a diesel or gas engine. As will be described, the fuel system 13 supplies fuel to the engine 12.

The fuel system 13 generally includes a fuel tank 14 for storage of fuel (e.g., diesel fuel, gasoline, etc.). The fuel system 13 also includes a pump assembly 18. As will be described, the operation of the pump assembly 18 causes fuel to be pumped from the fuel tank 14 to the engine 12 via a main fuel line 16. In some embodiments, the fuel system 13 is a returnless fuel system meaning that fuel flows between the fuel tank 14 and the engine 12 through the main fuel line 16 without a separate return line for the return of excess fuel from the engine 12 to the fuel tank 14. However, it will be appreciated that the fuel system 13 could be adapted for a return-type fuel system 13 without departing from the scope of the present disclosure.

Furthermore, the fuel system 13 includes a controller, schematically illustrated at 20. The controller 20 controls operation of the pump assembly 18. As will be described in greater detail below, the controller 20 selectively changes operation of the pump assembly 18 between an electronic returnless fuel system (ERFS) mode and a mechanical returnless fuel system (MRFS) mode. In the ERFS mode, output of the pump assembly 18 is varied, and in MRFS mode, output of the pump assembly 18 is maintained approximately constant. As will be discussed, switching between the ERFS and MRFS modes can allow for increased efficiency of the fuel system 13, and the fuel system 13 is less likely to malfunction.

Now referring to FIG. 2, the fuel tank 14 according to various embodiments will be discussed. As shown, the fuel tank 14 can be a saddle-type fuel tank 14. As such, the fuel tank 14 includes a first side 22, a second side 24, and an intermediate portion 26. The first and second sides 22, 24 of the fuel tank 14 can hold fuel. The intermediate portion 26 is disposed between the first and second sides 22, 24 of the fuel tank 14, and the volume of the intermediate portion 26 is significantly reduced compared to the first and second sides 22, 24. Accordingly, the overall shape of the fuel tank 14 can be configured to fit more compactly within the vehicle 10. However, it will be appreciated that the fuel tank 14 can be of any suitable shape without departing from the scope of the present disclosure.

Figure 2:
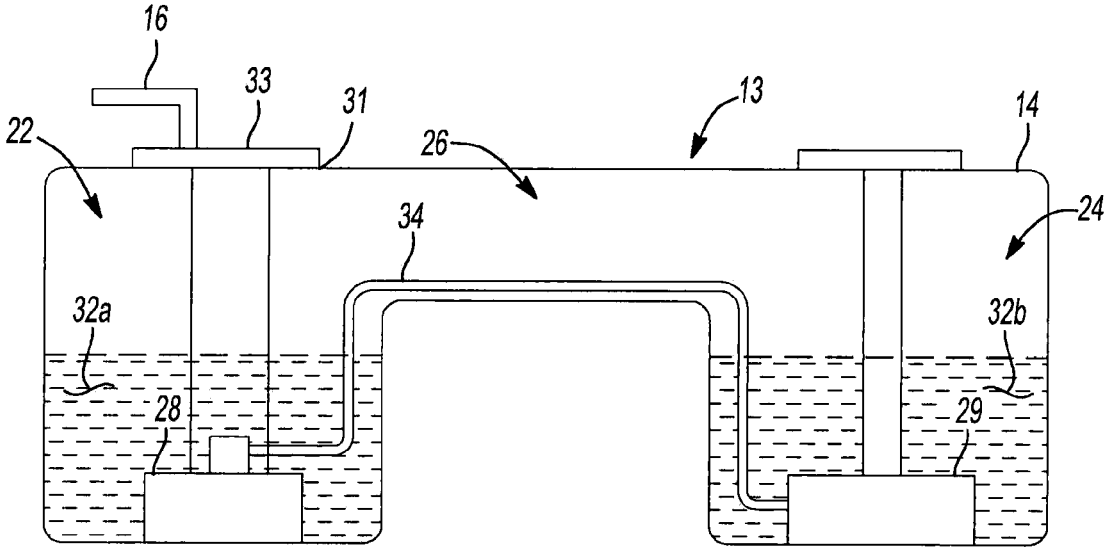
FIG. 2 is a side view of a fuel tank of the vehicle of FIG. 1.

Also, as shown in FIG. 2, the pump assembly 18 can include a first pump assembly member, schematically illustrated at 28, and a second pump assembly member, schematically illustrated at 29. The second pump assembly member 29 pumps fuel 32 from the second side 24 of the fuel tank 14 to the first side 22 of the fuel tank 14 via a communication line 34. The first pump assembly member 28 pumps fuel 32 on the first side 22 of the fuel tank 14 to the engine 12 via the main fuel line 16. It will be appreciated that the pump assembly 18 can also include other suitable components, such as an evaporative fuel pump system (not shown).

Figure 3:
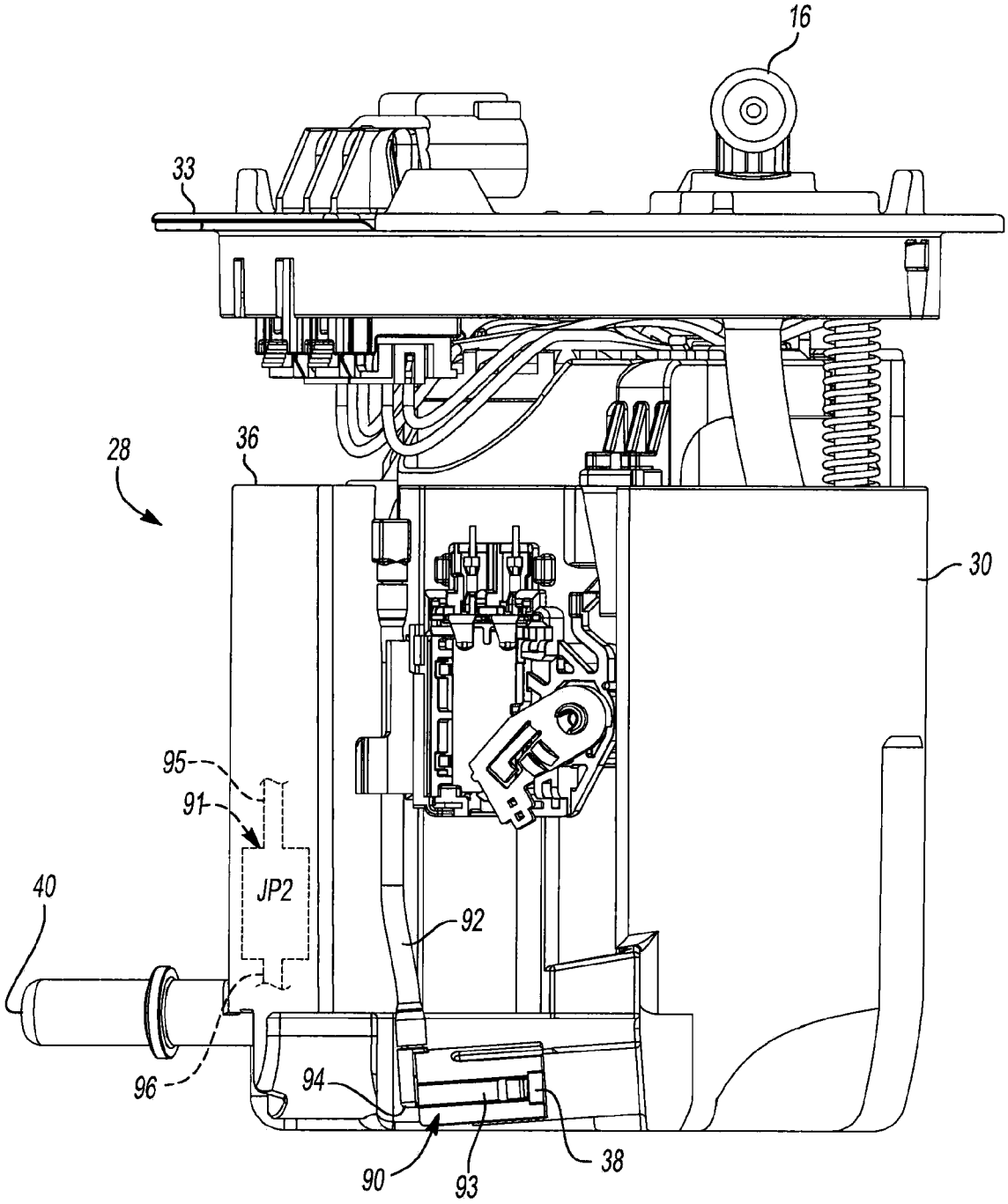
FIG. 3 is a side view of a fuel pump assembly within a secondary reservoir of the fuel system of FIG. 1.

As shown in FIG. 3, the first pump assembly member 28 can be disposed within a secondary reservoir 30 (i.e., bucket). Also, the first pump assembly member 28 can be coupled to a flange 33, which covers an opening 31 (see FIG. 2) in the fuel tank 14.

The secondary reservoir 30 is substantially hollow and includes an open top end 36 through which the first pump assembly member 28 extends. The secondary reservoir 30 can also include a first inlet 38 and a second inlet 40. As will be explained in greater detail below, fuel 32*a* within the first side 22 of the fuel tank 14 enters the secondary reservoir 30 via the first inlet 38, and fuel 32*b* within the second side 24 of the fuel tank 14 enters the secondary reservoir 30 through the second inlet 40. Then, as will be explained in greater detail, fuel within the secondary reservoir 30 is pumped by the first pump assembly member 28 to the engine 12 of the vehicle 10 via the main fuel line 16.

Figure 4:
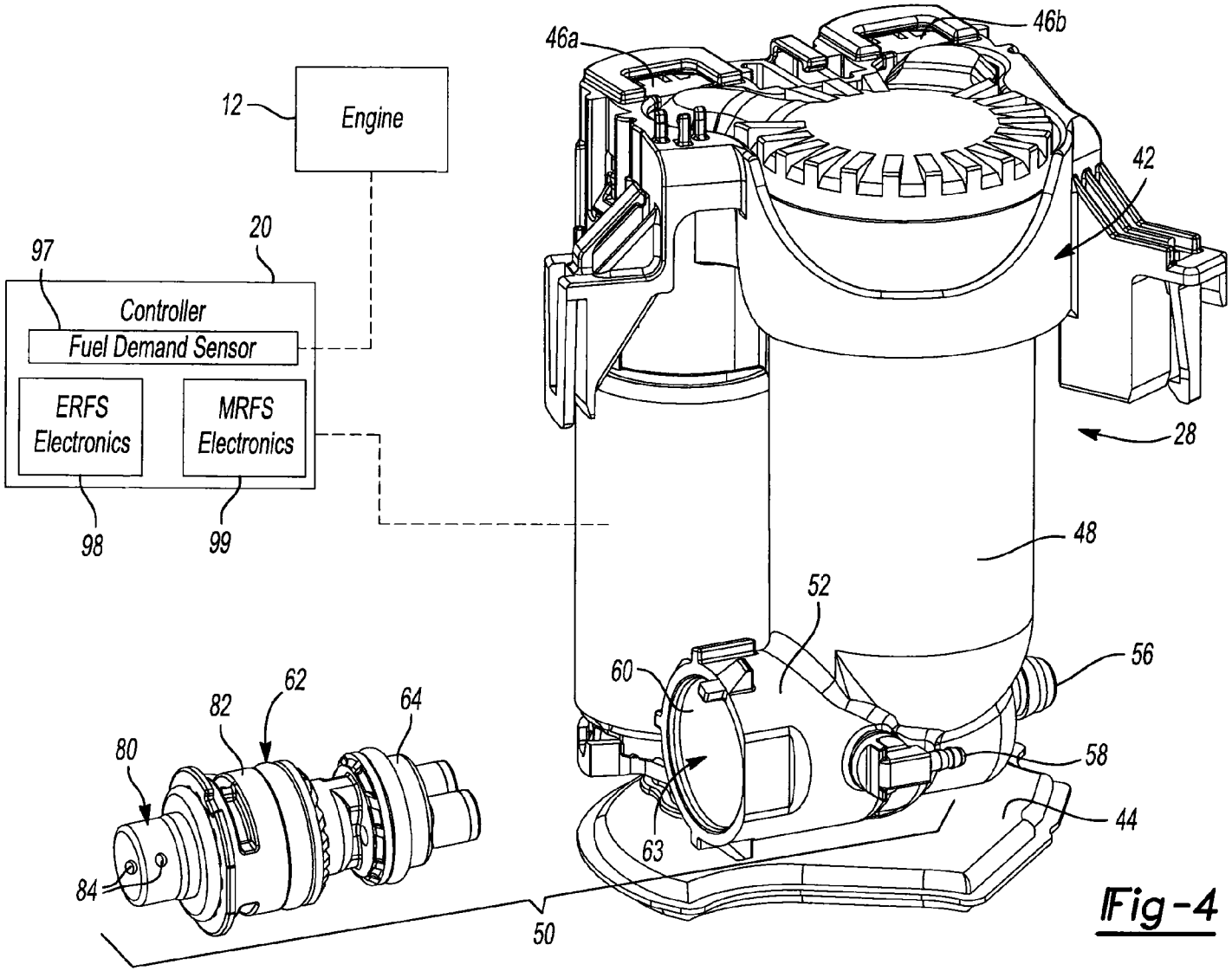
FIG. 4 is a perspective and partially exploded view of the fuel pump assembly of FIG. 3.
Figure 5:
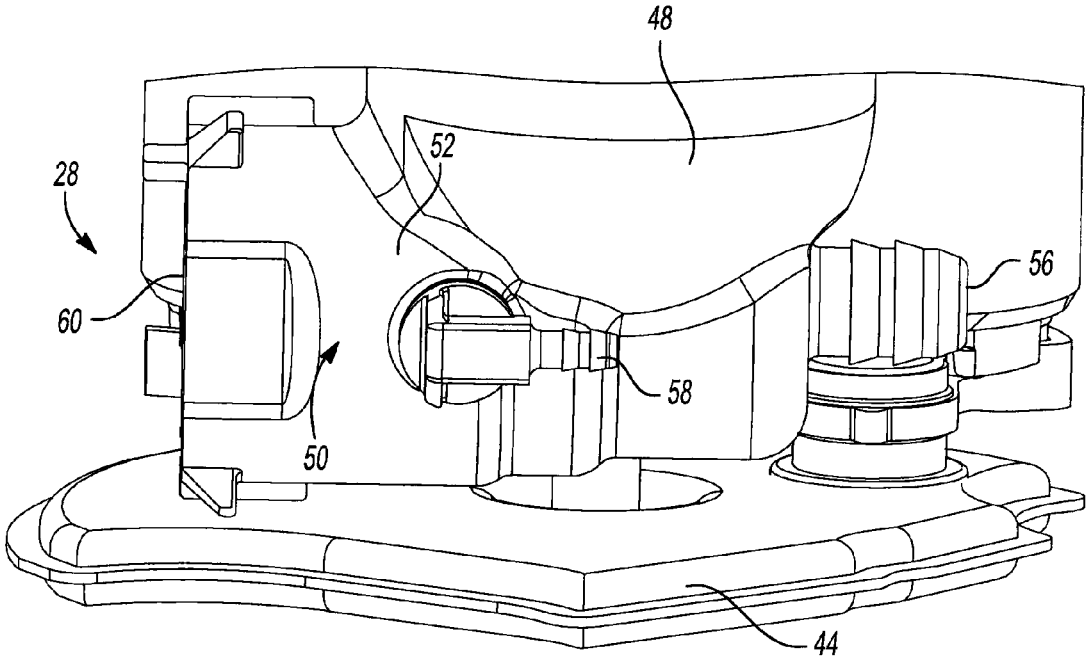
FIG. 5 is a perspective view of a lower portion of the fuel pump assembly of FIG. 4.
Figure 8:
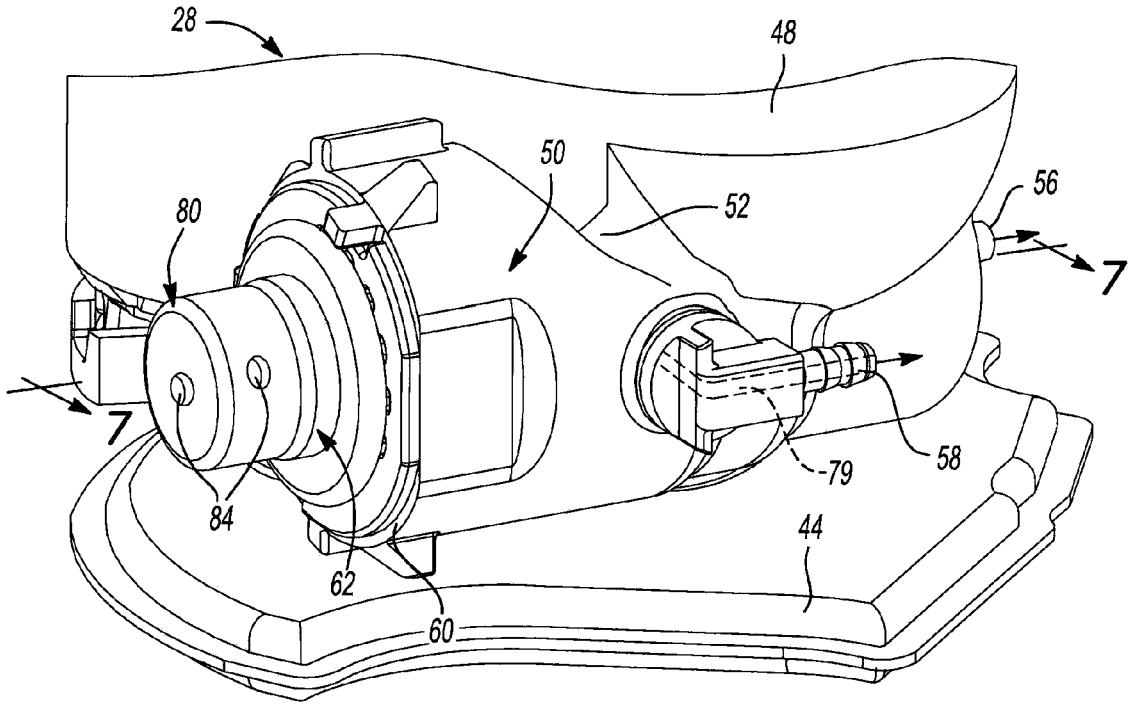
FIG. 8 is a perspective view of a lower portion of the fuel pump assembly of FIG. 4.
Figure 9:
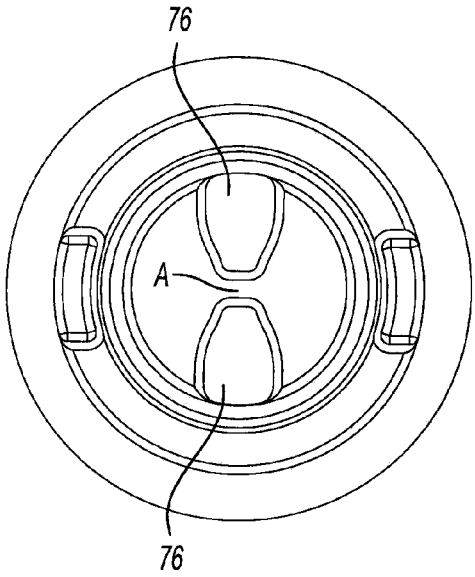
FIG. 9 is an end view of a flow insert member of the fuel system taken along the line 9-9 of FIG. 6.

Now referring to FIGS. 4, 5 and 8, various embodiments of the first pump assembly member 28 are illustrated. It will be appreciated that the secondary reservoir 30 is not shown in FIGS. 4, 5 and 8 for purposes of clarity. As shown, the first pump assembly member 28 can include a support assembly 42. The support assembly 42 supports the first fuel pump assembly member 28 within the secondary reservoir 14. The support assembly 42 is coupled to the flange 33.

The first pump assembly member 28 further includes a suction filter 44 (i.e., a sock). The suction filter 44 is made of a porous material and is operable for filtering fuel. In some embodiments, the suction filter 44 abuts an interior bottom surface of the secondary reservoir 30. The suction filter 44 can be of any suitable known type.

The first pump assembly member 28 further includes a first pump 46*a* and a second pump 46*b*. It will be appreciated that the first pump assembly member 28 can include any number of pumps 46*a*, 46*b*. In some embodiments, the pumps 46*a*, 46*b* are each electric pumps; however, it will be appreciated that the pumps 46*a*, 46*b* could be of any suitable type, such as hydraulic pumps and the like. As will be explained in greater detail below, the controller 20 controls output of the pumps 46*a*, 46*b* to thereby control the fuel system 13 of the vehicle 10. In some embodiments, the controller 20 controls the operation of the pumps 46*a*, 46*b* by controlling the voltage supplied to the pumps 46*a*, 46*b* from a power source, such as a battery, alternator, etc.

The first pump assembly member 28 additionally includes a filter member 48. The filter member 48 can be of any suitable known type. The filter member 48 additionally filters the fuel 32*a*, 32*b* to filter out contaminants therefrom.

The first pump assembly member 28 further includes a junction member assembly 50. As will be described in greater detail, fuel within the secondary reservoir 30 is sucked through the suction filter 44, into the first and second pumps 46*a*, 46*b*, through the filter member 48, and into the junction member assembly 50.

As shown in FIGS. 4-10, the junction member assembly 50 includes an outer housing 52. The outer housing 52 is generally tubular and hollow and is coupled to the filter member 48. The outer housing 52 can include an inlet 54 (FIG. 7) and an engine outlet 56 (FIGS. 4, 5, 7 and 8). Furthermore, the outer housing 52 defines a jet pump outlet 58 (FIGS. 4, 5 and 8). Moreover, the outer housing 52 of the junction member assembly 50 defines a pressure regulator outlet 60 (FIGS. 4, 5, 7 and 8).

Additionally, the junction member assembly 50 can include an insert assembly 62 (FIGS. 4, 6, 7 and 8). The insert assembly 62 is disposed substantially within a main chamber 63 of the outer housing 52 of the junction member assembly 50. As will be described in greater detail, the insert assembly 62 directs flow of fuel entering through the inlet 54 and out of the junction member assembly 50 via the engine outlet 56, the jet pump outlet 58, and the pressure regulator outlet 60.

Figure 6:
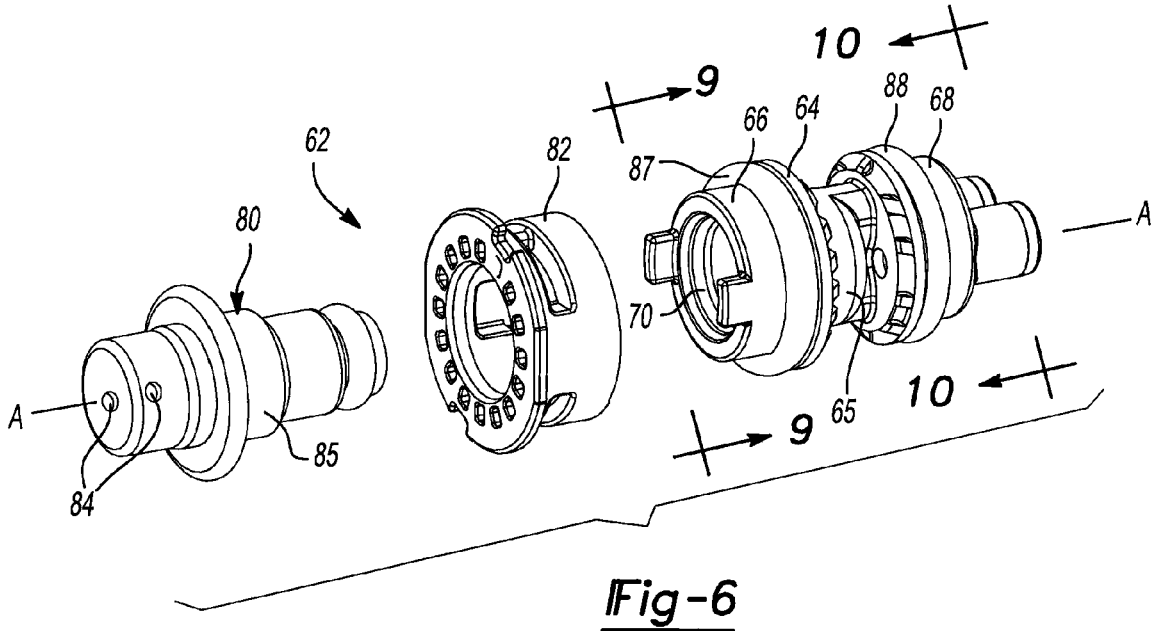
FIG. 6 is an exploded perspective view of a portion of a junction member assembly of the fuel pump assembly of FIG. 4.
Figure 7:
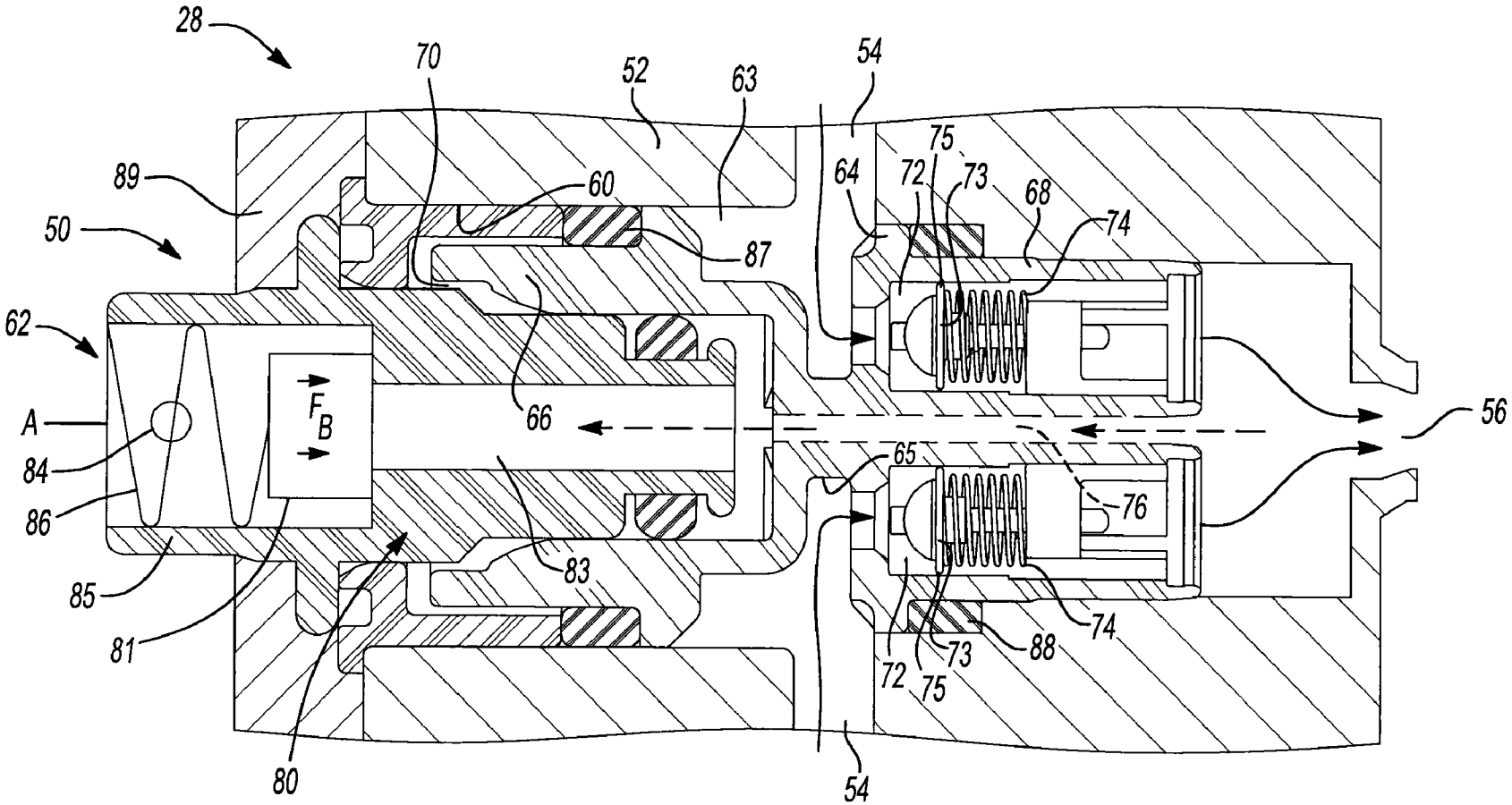
FIG. 7 is a section view of the fuel pump assembly taken along the line 7-7 of FIG. 8.

As most clearly shown in FIGS. 4, 6 and 7, the insert assembly 62 includes a flow insert member 64. The flow insert member 64 includes a first end 66 and a second end 68. The flow insert member 64 is substantially cylindrical, but a middle portion of the flow insert member 64 has a reduced diameter so as to define a groove 65 between the first and second ends 66, 68. The first end 66 of the flow insert member 64 is substantially cup shaped so as to define an aperture 70.

Figure 10:
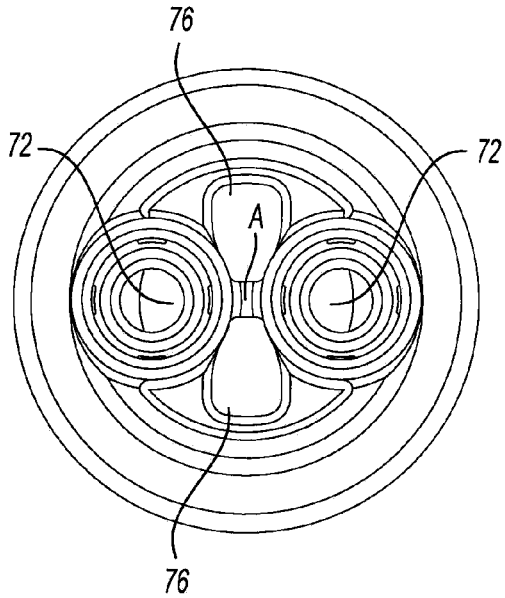
FIG. 10 is an end view of the flow insert member assembly taken along the line 10-10 of FIG. 6.

A plurality of first passages 72 extend through the second end 68 of the flow insert member 64. The first passages 72 extend substantially parallel along the axis A of the insert assembly 62. Each end of the first passage 72 is open such that each first passage 72 is in fluid communication with the groove 65 and the engine outlet 56. As shown in FIG. 10, the first passages 72 can be spaced about the axis A approximately 180° apart from each other.

Figure 7A:
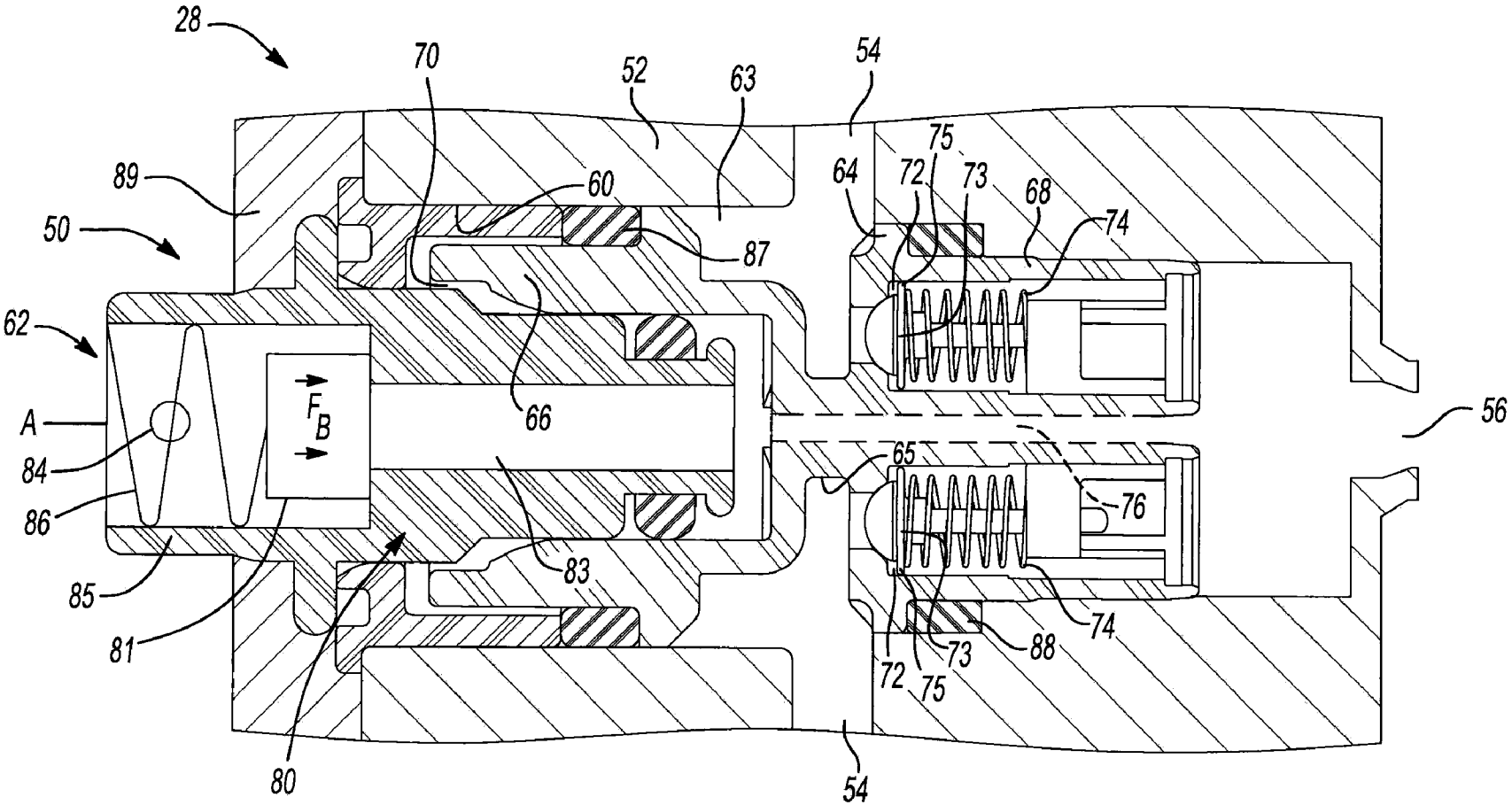
FIG. 7A is a section view of the fuel pump assembly taken along the line of 7-7 of FIG. 8, depicting check valves in a closed position.

A check valve 73 is operatively disposed in each of the first passages 72. The check valves 73 can be of a known type. Each check valve 73 includes a biasing member 74 that biases a valve member 75 towards a closed position to seal against the interior surface of the respective first passage 72. Fuel flow from the groove 65 to the engine outlet 56 moves the valve member 75 against the biasing force of the respective biasing member 74 into an open position. However, the biasing member 74 biases the valve member 75 to a closed position to restrict fuel flow in a direction from the engine outlet 56 to the groove 65, as depicted in FIG. 7A. In other words, each check valve 73 allows fuel flow from the pumps 46a, 46b, through the inlet 54, through the respective first passage 72, through the engine outlet 56, through the main fuel line 16, and to the engine 12. However, when closed, the check valves 73 restrict fuel flow through the respective first passage 72 in a direction away from the engine outlet 56 (i.e., away from the engine 12) and toward the inlet 54, thereby making the jet pump inlet 54 fluidly disconnected from the engine outlet 56 and the fuel line 16.

Furthermore, the flow insert member 64 includes a plurality of pressure regulator passages 76. As shown in FIG. 7, the pressure regulator passages 76 are open at both ends so as to be in fluid communication with the engine outlet 56 and the aperture 70. As such, the pressure regulator passages 76 allow fuel to flow away from the engine outlet 56 (i.e., away from the engine 12), toward the aperture 70, and out of the junction member assembly 50 through the pressure regulator outlet 60.

As shown in FIG. 10, the pressure regulator passages 76 can be disposed in spaced relationship about the axis A of the junction member assembly 50. In some embodiments, the pressure regulator passages 76 can be spaced 180° from each other, and the pressure regulator passages 76 can be spaced approximately 90° away from the first passages 72.

The groove 65 additionally fluidly connects the inlet 54 and the jet pump outlet 58. More specifically, as shown in FIG. 8, the jet pump outlet 58 is fluidly connected to the main chamber 63 via a second passage 79. As such, fuel entering the main chamber 63 via the inlet 54 can flow through the second passage 79 and out of the junction member assembly 50 through the jet pump outlet 58. It will be appreciated that the second passage 79 is fluidly disconnected from the pressure regulator passages 76.

The insert assembly 62 can also include a pressure regulator member 80 that includes a generally hollow shell housing 85 and a plug portion 81 that is movably disposed in an outlet passage 83 of the shell housing 85. The shell housing 85 is coupled to the flow insert member 64 in the aperture 70 adjacent the pressure regulator outlet 60. The outlet passage 83 is in fluid communication with the pressure regulator passages 76 of the flow insert member 64. A portion of the shell housing 85 extends out of the pressure regulator outlet 60, and this portion of the shell housing 85 defines a plurality of apertures 84 that are in fluid communication with the outlet passage 83.

Furthermore, the pressure regulator member 80 includes a biasing member 86 (FIG. 7) that is disposed within the shell housing 85 and provides a biasing force $F_B$ to the plug portion 81 such that the plug portion 81 is biased toward a closed position toward the flow insert member 64. In this closed position, the plug portion 81 substantially seals off the outlet passage 83 such that flow of fuel out of the outlet passage 83 through the apertures 84 is restricted. However, when pressure in the engine outlet 56 exceeds a predetermined pressure limit, excess fuel flows through the pressure regulator passages 76, through the outlet passage 83, and moves the plug portion 81 to an open position against the biasing force $F_B$, provided by the biasing member 86. This allows the fuel to flow out from the junction member assembly 50 through the apertures 84. This fuel then enters the secondary reservoir 30. Accordingly, the pressure regulator member 80 limits fuel pressure supplied to the engine 12 up to a predetermined pressure limit.

It will be appreciated that the biasing member 86 could be of any suitable type, such as a coiled spring. Furthermore, in some embodiments, a clip 89 (FIG. 7) is also included that supports the shell housing 85 of the pressure regulator member 80 and retains the pressure regulator member 80 in the junction member assembly 50.

The junction member assembly 50 further includes a spacer 82. The spacer 82 is substantially ring-shaped and encircles an outer surface of the first end 66 of the flow insert member 64. Also, the shell housing 85 extends through the spacer 82 and into the aperture 70 of the flow insert member 64. As such, the spacer 82 is disposed between the pressure regulator member 80 and the flow insert member 64.

The junction member assembly 50 additionally includes a plurality of seals, such as O-rings for sealing the various components against the outer housing 52 of the junction member assembly 50. For instance, the junction member assembly 50 includes a first O-ring 87 encircling the first end 66 of the flow insert member 64. The first O-ring 87 seals against the outer surface of the flow insert member 64 and an inner surface of the main chamber 63. The junction member assembly 50 further includes a second O-ring 88 encircling the second end 68 of the flow insert member 64. The second O-ring 88 seals against the outer surface of the flow insert member 64 and against an inner surface of the main chamber 63. It will be appreciated that the junction member assembly 50 can include any number of sealing members, and the sealing members can be of any suitable type.

In some embodiments, the flow insert member 64 is manufactured via a molding process. Because the spacer 82 is separate from the flow insert member 64, any molding seams (i.e., ridges formed where molds come together) can be formed away from the first and second O-rings 87, 88. Accordingly, the O-rings 87, 88 can create a better seal against the flow insert member 64 and leakage of fuel is less likely.

As shown in FIG. 3, the first pump assembly member 28 can also include a plurality of jet pumps, such as a first jet pump 90 and a second jet pump 91. The first jet pump 90 includes an inlet hose 92 that is in fluid communication with the jet pump outlet 58. The inlet hose 92 extends out from the secondary reservoir 30 and towards the bottom of the first side 22 of the fuel tank 14. The first jet pump 90 further includes an outlet passage member 93, which is in fluid communication with the first inlet 38 of the secondary reservoir 30. As is known in the art, the first jet pump 90 includes an aperture 94 between the inlet hose 92 and the outlet passage member 93. In operation, fuel flows through the inlet hose 92 and into the outlet passage member 93. A vacuum is formed adjacent the aperture 94 such that fuel within the first side 22 of the fuel tank 14 is sucked through the aperture 94 into the outlet passage member 93 and into the secondary reservoir 30 through the first inlet 38.

The second jet pump 91 is substantially disposed within the secondary reservoir 30. The second jet pump 91 includes an inlet passage member 95 and an outlet passage member 96. The inlet passage member 95 is in fluid communication with the jet pump outlet 58. The outlet passage member 96 is in fluid communication with the interior of the secondary reservoir 30 adjacent an interior end of the second inlet 40. In operation, as fuel flows from the jet pump outlet 58, through the inlet passage member 95 and out through the outlet passage member 96 into the secondary reservoir 30, a vacuum is formed between the outlet passage member 96 and the second inlet 40 such that fuel is sucked from the second side 24 of the fuel tank 14, through the communication line 34, and into the secondary reservoir 30.

The fuel flow of the pump assembly 18 in various embodiments will now be summarized. During operation of the pumps 46*a*, 46*b*, fuel flows into the secondary reservoir 30 through the first inlet 38 via the first jet pump 90. Additional fuel flows into the secondary reservoir 30 through the second inlet 40 via the second jet pump 91. Fuel within the secondary reservoir 30 flows through the suction filter 44 and past the first and second pumps 46*a*, 46*b*. This fuel is pumped through the filter member 48 and into the junction member assembly 50 through the inlet 54. A first portion of the fuel entering through the inlet 54 flows through the first passages 72 past the check valve 73, through the engine outlet 56, and to the engine 12 via the main fuel line 16. A second portion of fuel entering through the inlet 54 flows through the second passage 79, through the jet pump outlet 58 and is divided between the first and second jet pumps 90, 91 to pump additional fuel into the secondary reservoir 30.

When fuel pressure supplied to the engine 12 exceeds a predetermined pressure limit, the plug portion 81 of the pressure regulator member 80 moves away from the flow insert member 64 against the biasing force $F_B$ to an open position, thereby unsealing the outlet passage 83 and allowing fuel to flow back into the secondary reservoir 30 via the apertures 84. More specifically, fuel flowing to the engine 12 from the first passages 72 is supplied at a fuel pressure, and when the fuel pressure supplied to the engine 12 exceeds a predetermined limit, the fuel flows back through the pressure regulator passages 76, through the outlet passage 83, and automatically opens the pressure regulator member 80 to flow into the secondary reservoir 30 via the apertures 84. Accordingly, fuel pressure can be regulated and fuel can be supplied to the engine 12 at a desired pressure.

As stated above, the controller 20 controls the output of the pump assembly 18 between an ERFS mode and an MRFS mode. In some embodiments, the controller varies the output of the pump assembly 18 by varying the voltage supplied to the pumps 46*a*, 46*b* in the ERFS mode. Also, in some embodiments, the controller 20 maintains output of the pump assembly 18 in the MRFS mode by maintaining approximately fixed voltage supply to the pumps 46*a*, 46*b*.

In some embodiments, the controller 20 changes operation of the pump assembly 18 according to a fuel demand of the engine 12. Thus, in some embodiments, the fuel system 13 can include a fuel demand sensor 97 (FIG. 4) for detecting the fuel demand of the engine 12. The fuel demand sensor 97 can detect the fuel demand of the engine 12 in any suitable manner, such as by detecting a position of a throttle (not shown), and/or communicating with an electronic engine control unit.

If the fuel demand detected by the fuel demand sensor 97 is lower than or equal to a predetermined limit, the controller 20 operates the pump assembly 18 in the ERFS mode, and if the detected fuel demand exceeds the predetermined limit, the controller operates the pump assembly 18 in the MRFS mode. In other words, the controller 20 changes operation of the pump assembly 18 from the MRFS mode to the ERFS mode when the fuel demand of the engine is at most equal to the predetermined limit. Also, the controller 20 changes from the ERFS mode to the MRFS mode when the fuel demand of the engine 12 is above the predetermined limit. Thus, when demand of the engine 12 is low (e.g., when traveling at a constant velocity, downhill, etc.), the controller 20 operates the pump assembly 18 in the ERFS mode, and when demand of the engine 12 is high (e.g., when accelerating, etc.), the controller 20 operates the pump assembly 18 in the MRFS mode.

In various embodiments illustrated in FIG. 4, the controller 20 includes an ERFS electronics assembly 98 and an MRFS electronics assembly 99. The ERFS electronics assembly 98 and the MRFS electronics assembly 99 each include a plurality of circuits, programmed logic, and the like. The ERFS electronics assembly 98 and the MRFS electronics assembly 99 are substantially separate. The ERFS electronics assembly 98 is operative for operating the pump assembly 18 in the ERFS mode, and the MRFS electronics assembly 99 is operative for operating the pump assembly 18 in the MRFS mode. It will be appreciated that the controller 20 could include electronic components that are operated commonly in both the MRFS and ERFS modes. In some embodiments, the ERFS electronics assembly 98 is inoperative when the pump assembly 18 is operated in the MRFS mode. Furthermore, in some embodiments, the MRFS electronics assembly 99 is inoperative when the pump assembly 18 is operated in the ERFS mode. As such, the electronics assemblies 98, 99 are less likely to malfunction due to high electrical load.

Additionally, as described above, the plug portion 81 of the pressure regulator member 80 is biased in a closed position, and the plug portion 81 moves to an open position when fuel pressure supplied to the engine 12 exceeds a predetermined pressure limit. In some embodiments, the controller 20 controls the pump assembly 18 in the ERFS mode such that the fuel pressure supplied to the engine 12 is below the predetermined pressure limit. Accordingly, the plug portion 81 is likely to remain in the closed position while the pump assembly 18 is operated in the ERFS mode. In other words, since the pump assembly 18 can be operated in the ERFS mode when fuel demand is low, fuel can be supplied at a relatively low pressure, and the pressure regulator member 80 is likely to remain in the closed position. Also, when the controller 20 changes operation of the pump assembly 18 to the MRFS mode, the fuel can be supplied at a higher pressure, and the plug portion 81 can move between the open and closed positions to thereby maintain proper pressure to the engine 12.

It will be appreciated that the fuel system 13 disclosed herein allows for increased efficiency during operation. Furthermore, the fuel system 13 is less likely to malfunction. Additionally, the fuel system 13 is relatively compact.

While the disclosure has been described in the specification and illustrated in the drawings with reference to various embodiments, it will be understood by those skilled in the art that various changes may be made and equivalents may be substituted for elements thereof without departing from the scope of the disclosure as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the disclosure without departing from the essential scope thereof. Therefore, it is intended that the disclosure not be limited to the particular embodiment illustrated by the drawings and described in the specification as the best mode presently contemplated for carrying out this disclosure, but that the disclosure will include any embodiments falling within the foregoing description and the appended claims.

What is claimed is:

1. A fuel system that supplies fuel to an engine of a vehicle, the fuel system comprising:

a pump that pumps fuel to an engine fuel line;

a check valve, when closed, secured to a closed position by fuel pressure in the engine fuel line and a biasing spring;

a junction member assembly located adjacent to a fuel suction filter of the pump, the junction member assembly further comprising:

an outer housing defining an inlet, a pressure regulator outlet, a jet pump outlet and an engine outlet for fuel;

a flow insert member located within the outer housing, the flow insert member defining a flow insert member first passage that directs fuel into a check valve, defining a flow insert member pressure regulator fluid passage that is axially aligned with the engine outlet for fuel, defining a second passage that directs fuel from the pump to a jet pump through the jet pump outlet;

a pressure regulator member that nests within each of the flow insert member, the outer housing and the pressure regulator outlet;

wherein a first portion of fuel flows from the inlet, through the flow insert member first passage, through the check valve and through the engine outlet;

wherein a second portion of fuel flows from the inlet, through the second passage, and through the let pump outlet; and wherein fuel flows from the first passage, flows through the flow insert member pressure regulator fluid passage, changes the pressure regulator member to an open position, and flows out of the junction member assembly when fuel pressure supplied to the engine exceeds a predetermined pressure limit, the jet pump outlet on the junction member assembly fluidly disconnected from the engine outlet by the check valve, when closed, the check valve, located in the outer housing of the junction member assembly in the first passage between the jet pump outlet and the engine outlet;

a controller that selectively changes operation of the pump between an electronic returnless fuel system (ERFS) mode, in which output of the pump is varied, and a mechanical returnless fuel system (MRFS) mode, in which output of the pump is maintained approximately constant; and wherein the pressure regulator member defines an outlet passage that receives incoming fuel from the pressure regulator passage and that limits a fuel pressure supplied to the engine up to a predetermined pressure limit, wherein the junction member assembly is arranged so that the pressure regulator passage is axially aligned with the outlet passage of the pressure regulator member to permit fuel in the first passage to flow away from the engine when fuel pressure supplied to the engine exceeds a predetermined pressure limit, and wherein the pressure regulator passage is fluidly blocked from the fuel pump when the check valve is closed and the pressure regulator is open.

2. The fuel system of claim 1, wherein the output of the pump is varied in the ERFS mode by varying a voltage supplied to the pump, and wherein the output of the pump is maintained approximately constant in the MRFS mode by maintaining the voltage supplied to the pump approximately constant.

3. The fuel system of claim 1, wherein the controller includes an ERFS electronics assembly and an MRFS electronics assembly, and wherein the MRFS electronics assembly is operative and the ERFS electronics assembly is inoperative when the pump is in the MRFS mode.

4. The fuel system of claim 1, wherein the controller changes operation of the pump between the ERFS and the MRFS modes according to a fuel demand of the engine.

5. The fuel system of claim 4, wherein the controller changes operation of the pump from the MRFS mode to the ERFS mode when the fuel demand of the engine is at most a predetermined limit, and wherein the controller changes from the ERFS mode to the MRFS mode when the fuel demand of the engine is above the predetermined limit.

6. The fuel system of claim 1, wherein the pressure regulator member is biased toward a closed position and changes to an open position when the fuel pressure supplied to the engine exceeds the predetermined pressure limit.

7. The fuel system of claim 1, wherein the controller controls operation of the pump in the ERFS mode such that the fuel pressure supplied to the engine is below the predetermined pressure limit.

8. The fuel system of claim 1, wherein the pressure regulator passage is located parallel to, spatially between, and equidistant from the plurality of check valves.

9. The fuel system of claim 1, further comprising:

a filter member, wherein the junction member assembly further comprises an outer housing that is integrally molded with part of the filter member.

10. The fuel system of claim 1, wherein the pressure regulator, the plurality of check valves, the flow insert member pressure regulator fluid passage, and engine outlet of the outer housing are symmetrical about a single longitudinal axis.

11. The fuel system of claim 1, wherein the flow insert member further comprises an outside diameter that permits insertion within the outer housing to thereby located the check valve proximate to an engine outlet of the outer housing.

12. A method of operating a fuel system for a vehicle with an engine and a fuel pump, the method comprising:

operating the fuel pump in an electronic returnless fuel system (ERFS) mode, in which output of the pump is varied, when a fuel demand of the engine is at most a predetermined limit;

operating the fuel pump in a mechanical returnless fuel system (MRFS) mode, in which output of the pump is maintained approximately constant, when a fuel demand of the engine is above the predetermined limit, wherein operating the fuel pump in an electronic returnless fuel system (ERFS) mode further comprises limiting a fuel pressure supplied to the engine up to a predetermined pressure limit with a pressure regulator in a closed state, and operating the fuel pump in a mechanical returnless fuel system (MRFS) mode further comprises opening the pressure regulator to supply fuel to the engine at the predetermined pressure limit of the pressure regulator;

providing a plurality of check valves in a fuel path linking a jet pump outlet on a first side of the plurality of check valves and an engine outlet on a second side of the plurality of check valves, each check valve of the plurality of check valves having a spring;

providing a fuel line fluidly between the plurality of check valves and the engine;

providing a pressure regulator and a pressure regulator passage leading to the pressure regulator, the pressure regulator passage located spatially between the plurality of check valves, each check valve of the plurality of check valves positioned equidistant from the pressure regulator passage, wherein the pressure regulator passage has a longitudinal centerline that is coincident with a longitudinal centerline that is located equidistant from and spatially between the plurality of check valves, wherein each of the plurality of check valves has a cross-sectional area smaller than that of the pressure regulator;

providing a jet pump outlet spatially between the plurality of check valves and the pressure regulator;

closing the plurality of check valves when the fuel pump is not operating using fuel pressure in the fuel line and the spring of each check valve of the plurality of check valves, the fuel pressure and the spring of each check valve together acting on a same side of each check valve of the plurality of check valves, respectively, wherein the jet pump outlet is fluidly blocked from the engine outlet upon closing of the plurality of check valves; and maintaining an obstructed fuel path to the jet pump from the fuel line to the engine when the fuel pump is not operating, the plurality of check valves is closed, and the pressure regulator is open.

13. The method of claim 12, wherein operating the fuel pump in the ERFS mode comprises varying a voltage supplied to the pump, and wherein operating the fuel pump in the MRFS mode comprises maintaining the voltage supplied to the pump approximately constant.

14. The method of claim 13, further comprising providing an ERFS electronics assembly and a MRFS electronics assembly, operating the MRFS electronics assembly while operating the fuel pump in the MRFS mode, and disabling the ERFS electronics assembly while operating the fuel pump in the MRFS mode.

15. The method of claim 14, further comprising:

maintaining fuel pressure in the fuel line when the engine is not operating; and relieving pressure in a jet pump inlet tube while maintaining fuel pressure in the fuel line.

16. The method of operating a fuel system of claim 12, wherein the plurality of check valves, the pressure regulator, and the pressure regulator passage between the plurality of check valves are provided within a single housing.

17. The fuel system of claim 13, wherein:

the flow insert member is insertable within the outer housing, and the pressure regulator, plurality of check valves, flow insert member pressure regulator fluid passage, and engine outlet of the outer housing are symmetrical about a single longitudinal axis.

18. A fuel system that supplies fuel to an engine of a vehicle, the fuel system comprising:

a pump that pumps fuel;

a junction member assembly that is in fluid communication with the pump, the junction member including an outer housing defining an inlet, an engine outlet, a jet pump outlet, and a pressure regulator outlet, the junction member assembly also including a flow insert member that defines a first passage and a pressure regulator passage, the junction member assembly further including a pressure regulator member that is coupled to the flow insert member adjacent the pressure regulator outlet, the pressure regulator member at least partially residing within an outer housing of the junction member assembly, wherein a longitudinal centerline of the pressure regulator member, a longitudinal centerline of the pressure regulator passage and the engine outlet are axially aligned;

wherein a first portion of fuel flows from the inlet, through the first passage, and through the engine outlet;

wherein a second portion of fuel flows from the inlet, through a second passage, and through the jet pump outlet, wherein fuel in the engine outlet is prevented from flowing into the jet pump; and wherein fuel flows from the first passage, flows through the pressure regulator passage, changes the pressure regulator member to an open position, and flows out of the junction member assembly when fuel pressure supplied to the engine exceeds a predetermined pressure limit;

a controller that selectively changes operation of the pump between an electronic returnless fuel system (ERFS) mode, in which output of the pump is varied, and a mechanical returnless fuel system (MRFS) mode, in which output of the pump is maintained approximately constant, the controller changing operation of the pump from the MRFS mode to the ERFS mode when a fuel demand of the engine is at most a predetermined limit, the controller also changing operation of the pump from the ERFS mode to the MRFS mode when the fuel demand of the engine is above the predetermined limit, the controller additionally controlling operation of the pump in the ERFS mode such that the fuel pressure supplied to the engine is below the predetermined pressure limit; and a plurality of check valves located in the outer housing of the junction member assembly, wherein the pressure regulator passage is located parallel to and longitudinally between the plurality of check valves, and wherein the jet pump is fluidly blocked from the fuel line by the plurality of check valves, when closed, and the pressure regulator member, when open.

* * * * *

UNITED STATES PATENT AND TRADEMARK OFFICE

CERTIFICATE OF CORRECTION

PATENT NO. : 7,950,372 B2
APPLICATION NO. : 12/012475
DATED : May 31, 2011
INVENTOR(S) : Patrick Powell It is certified that error appears in the above-identified patent and that said Letters Patent is hereby corrected as shown below:

Col. 9, line 28, claim 1, “let” should be --jet--

Col. 10, line 34, claim 11, “located” should be --locate--

Signed and Sealed this
Ninth Day of August, 2011

David J. Kappos

David J. Kappos
*Director of the United States Patent and Trademark Office*